United States Patent [19]

Chepelev et al.

[11] 3,993,127

[45] Nov. 23, 1976

[54] APPARATUS FOR POSITIONING A WORKING IMPLEMENT IN A BOREHOLE

[76] Inventors: Viktor Gavrilovich Chepelev, Moskovsky prospekt, 232-A, kv. 10; Nikolai Nikolaevich Grinchenko, ulitsa Tonkopia, 24-A, kv. 26; Jury Moiseevich Goldshtein, ulitsa Olminskogo, 17, kv. 2; David Leonidovich Shvarts, ulitsa Olminskogo, 10, kv. 1; Nikolai Pavlovich Fetisenko, ulitsa Vtoroi Pyatiletki, 61, kv. 20; Vladimir Nikolaevich Grinchenko, ulitsa Kedrovaya, 20, all of Kharkov, U.S.S.R.

[22] Filed: Aug. 8, 1974

[21] Appl. No.: 495,680

[52] U.S. Cl. ..... 166/66; 73/151; 175/61; 340/18 R

[51] Int. Cl.[2] ..... E21B 47/024

[58] Field of Search ..... 73/151; 175/26, 45, 175/61; 340/18 R; 166/66

[56] References Cited

UNITED STATES PATENTS

| | | | |
|---|---|---|---|
| 2,658,284 | 11/1953 | Arps | 175/45 X |
| 3,224,513 | 12/1965 | Weeden, Jr. | 175/26 |
| 3,589,454 | 6/1971 | Coyne | 175/26 |

*Primary Examiner*—Jerry W. Myracle
*Attorney, Agent, or Firm*—Lackenbach, Lilling & Siegel

[57] ABSTRACT

An apparatus is intended for drilling inclined boreholes with high degree of accuracy.

The apparatus comprises a working implement having an electric drill and a deep compass with selsyn type sensors whose output signals carry the information on the position of the electric drill in the borehole.

Means for controlling the position of the working implement is connected to said sensors and generates a signal in accordance with deviation of the output signals of said sensors from preset values.

The output signal from said control means acts upon an actuator of the working implement to position it along a predetermined path.

4 Claims, 4 Drawing Figures

APPARATUS FOR POSITIONING A WORKING IMPLEMENT IN A BOREHOLE

The present invention relates to the drilling technology, and more particularly to apparatus for positioning a working implement in a borehole.

The present invention may be the most advantageously used in drilling deep and ultradeep horizontal and inclined boreholes where high accuracy of drilling along a predetermined path is required so as to obtain a minumum possible distance between the hole mouth and bottom.

The apparatus according to the invention is very efficient in drilling boreholes with the employment of an electric drill where the existence of a power supply line enables the transmission of the measurement data from the borehole bottom to the surface.

Known in the art are apparatus for positioning a working implement in a borehole comprising an electronic deep compass having deep-hole sensors sensing the angles of inclination, azimuth and position of a working implement, and surface instruments recording these angles, as well as an actuator comprising a drilling rig rotary table drive which is connected to the working implement by means of a drilling string. The working implement comprises a boring bit, a deep-hole motor, sensors of the electronic deep compass and means for shifting the working implement mounted between the deep-hole motor and the sensors. The transmission of signals from the sensors to the recording instruments of the electronic deep compass is effected by using a wire communication channel.

At present the determination of angle of the position of the working implement in the borehole in accordance with the difference between preset and measured angles of azimuth and borehole axis inclination, respectively, as well as the shifting of the working implement into the position required to ensure the reduction of the value of said difference are effected by an operator.

Known in the art are also instruments partially facilitating the task of the operator in the course of positioning of the working implement. Thus, it is known to use an instrument comprising three rules and two protractors. One rule is rigidly secured to a protractor which is connected to another rule by means of a pivot. The third rule is rigidly connected to the second protractor and is connected to a slider of the second rule by means of a pivot, while the slider of the second rule is connected by means of a pivot to a slider of the third rule. The rules are provided with uniform scales, and the protractors are graduated from 0° to 180°.

The operation, e.g. in changing the azimuth of a borehole, is the following. The slider of the second rule is positioned at the division corresponding to the angle of inclination of the borehole prior to the beginning of the drilling operation, and the slider is fixed by means of a stop screw. The slider of the third rule is positioned at the division corresponding to the value of angle of inclination of the borehole (in degrees) which is to be obtained after a portion of the borehole will be drilled. By rotating the first rule the angle corresponding to the change in the borehole azimuth is set up on the protractor connected to this rule.

After the above-described operations have been completed, the slider of the first rule will indicate the angle of inclination of the borehole axis at the end of drilling, while a required angle of positioning of the working implement can be read out on the protractor connected to the third rule at the pointer thereof.

Then the operator puts on the actuator to rotate the working implement at this angle while simultaneously checking-up the correct positioning by means of the sensor of the electronic compass sensing the position of the working implement.

The angle of rotation of the working implement in the borehole is measured with reference to the cardinal points or absidal plane which is the vertical plane extending through a tangent line to the borehole axis at the measurement point. The angle of inclination of the borehole is the angle between the vertical and a tangent line to the borehole axis at the measurement point. The azimuth is the angle between the magnetic meridian and apsidal plane extending through the point of measurement of the azimuth. The above-mentioned angles are measured by means of an electronic deep compass.

The electronic deep compass is designed for operation with an electric drill which is a part of the working implement. The transmission of data from the sensors of the electronic deep compass is effected via the electric drill power supply line. Where the borehole is drilled with the employment of a turbo-drill, a logging cable is used for connection of the electronic deep compass described herein, the cable being lowered into the drilling string after the working implement and the turbo-drill have been lowered to the well bottom.

Known apparatus for positioning the working implement in a borehole have serious disadvantages among which the most important one consists in an insufficient accuracy of positioning of the working implement, whereby the borehole deviates to a large extend from a predetermined path. In addition, the technique for the calculation of the angle of rotation of the working implement so as to maintain a required path thereof is very complicated and labour consuming.

The above-mentioned operations required to position the working implement during the drilling of a borehole are to be effected repeatedly during the drilling, as well as after every string feeding. This negatively affects the speed and accuracy of measurements which also depend on the individual ability of the operator monitoring the actuator of the working implement.

It is an object of the present invention to provide an apparatus for positioning a working implement with high accuracy.

Another object of the present invention is to provide an apparatus for positioning a working implement which ensures better operating conditions for the operator at the drilling rig.

Still another object of the invention is to provide an apparatus for positioning a working implement which permits to automatize the process of controlling the working implement during the drilling.

These and other objects are accomplished due to the fact that in an apparatus for positioning a working implement in a borehole comprising an electronic deep compass having deep-hole sensors sensing the angle of inclination of the borehole axis with respect to the vertical, the azimuth of the borehole and the position of the working implement as referred to the vertical plane tangential to the borehole axis at the measurement point, and a surface means for controlling the position of the working implement having an actuator and controlled by signals from said sensors in accordance with deviations of the output signals from preset values, according to the invention, said means for controlling the position of the working implement comprises three comparison circuits of which two circuits are connected in such manner that one circuit is coupled to a borehole azimuth sensor and controller and the other to a borehole inclination angle sensor and controller, one of said circuits generating a sine signal and the other a cosine signal, the amplitude of each signal being proportional to the difference between the signals of the sensor and controller, and both said circuits being connected to an algebraic adder, said adder being connected, together with the working implement position sensor, to a third comparison circuit having an output connected to the actuator so as to control the operation thereof, whereby the positioning of the working implement is effected until the signal at the output of the third circuit becomes nil.

The algebraic adder may comprise a rotary sine-cosine transformer inserted in such a manner as to determine the hypotenuse and angle with preset catheti of a triangle and an angle electric signal converter comprising a variable resistor having a sliding contact connected to the rotor of the rotary transformer.

The algebraic adder may alternatively comprise two transformers each having a primary winding connected to one of the comparison circuits for preset and measured angles of inclination and azimuth of the borehole, the secondary windings being connected in series and coupled to a phase-sensitive rectifier whose reference voltage is in phase with the voltage supplied to the primary winding of one of the transformers.

The comparison circuits for preset and measured angles of inclination and azimuth of the borehole may comprise a magnetic amplifier having an output frequency which is twice as high as the frequency of the voltage supplied to the working windings thereof, one working winding being supplied with sine voltage and the other with cosine voltage.

The present invention allows a continuous correction of the position of the working implement to be effected during the drilling so as to maintain a predetermined path of the borehole.

This is also favoured by the fact that all the operations of the positioning of the working implement (comparison of measured and preset values of the borehole azimuth and angles characterizing the position of the working implement, as well as subsequent control of the working implement) are effected automatically.

The employment of the apparatus according to the invention permits to cut down the drilling cost and to speed-up the borehole drilling which is drilled along an optimal path with the minimum possible distance between the mouth and the borehole and the design bottom thereof.

The invention ensures the drilling of the borehole along a productive bed, the drilling of branched horizontal boreholes and multiple boreholes to increase the yield thereof as well as the drilling of special boreholes for controlling fire in the burning wells.

Other objects and advantages of the invention will become apparent from the following detailed description of an embodiment thereof with reference to the accompanying drawings, in which.

Figure 1:
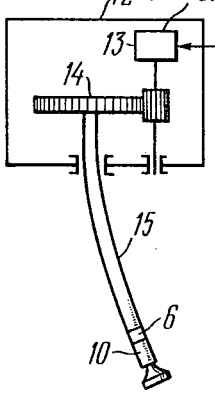
FIG. 1 shows a block diagram of the apparatus according to the invention.

The apparatus according to the invention comprises a controller 1 (FIG. 1) of the azimuth and a controller 2 of the angle of inclination of the borehole each being connected to comparison circuits 3 and 4, respectively, to which there are also connected a borehole azimuth sensor 5 of an electronic deep compass 6 and a borehole inclination angle sensor 7. An algebraic adder 8 having an input connected to the comparison circuits 3 and 4 has an output connected, together with the output of a sensor 9 sensing the position of a working implement 10, to a comparison circuit 11 having an output connected to an actuator 12.

The actuator comprises an electric drive 13, a rotor 14 and a drilling string 15.

The working implement 10 comprises a deep-hole motor and means for shifting the working implement (not shown).

The sensors 5, 7 and 9 of the electronic deep compass 6 are accomodated above the deep-well motor within a non-magnetic portion of the drilling string 15 in a tightly sealed container (not shown) and are fixed to a movable frame having off-center weights performing as plumbs, the axis of rotation of the frame coinciding with the axial line of the portion of the drilling string. Each of the sensors 5, 7, 9 comprises a rotary sine-cosine transformer (not shown), the rotor of the rotary transformer associated with the sensor 9 sensing the position of the working implement 10 being coaxially secured to said frame and the stator thereof being fixed to the portion of the drilling string 15. The stator of the rotary transformer associated with the borehole inclination angle sensor 7 is fixed to the frame so that the rotational axis of the rotor having an off-center weight is normal to the rotational axis of the frame. The azimuth sensor 5 comprises a magnetic rod (pointer) which is fixed normally to the rotor shaft of the rotary transformer having its stator fixed to a shaft connected to an off-center weight, the axis of the shaft being normal to the frame axis and to the axis of rotor of the rotary transformer. This construction of the sensors 5, 7, 9 ensures the correspondence of the angles between the rotor and stator of the rotary transformers to the angles of inclination and azimuth of the borehole, as well as to the angle of the position of the working implement 10. The value of these angles is measured by the sensors 5, 7, 9 and is transmitted via the power supply line of the electric drill to surface recording instruments (not shown) of the electronic deep compass 6.

Figure 2:
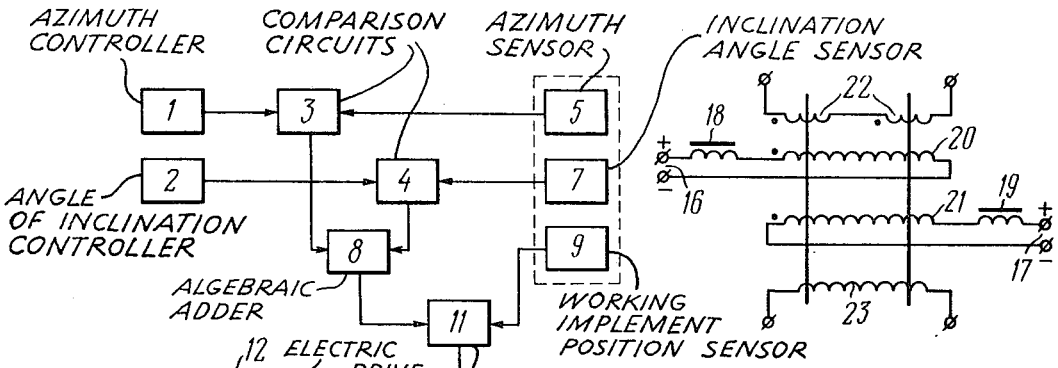
FIG. 2 is an electric diagram of one of the comparison circuits.

The comparison circuits 3 and 4 comprise a magnetic amplifier (FIG. 2) having a circuit such as to obtain an output frequency which is twice as high as the frequency of the voltage supplied to the working windings thereof, the amplifier having inputs 16 and 17 each connected, via chokes 18 and 19, to windings 20 and 21, respectively, having opposite ampere-turns. One working winding 22 of the magnetic amplifier of the comparison circuit 3 is supplied with sine voltage, and the other winding 22 of the comparison circuit 4 is supplied with cosine voltage. A twice frequency output signal whose amplitude is proportional to the difference value is obtained at the output winding 23 of the magnetic amplifier. The chokes 18 and 19 are used as twice-frequency filters.

The comparison of the signals may be as well effected before the magnetic amplifier, for instance by means of a bridge circuit (not shown) having adjacent arms into which there are oppositely inserted the output voltages from the controller and sensor, respectively, of the inclination angle or azimuth sensor, and the output of this circuit may be coupled to one of the inputs 16 or 17 of the magnetic amplifier.

Figure 3:
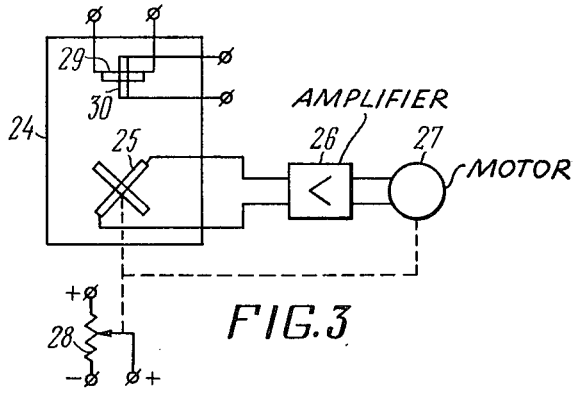
FIG. 3 is a functional diagram of an algebraic adder.

The algebraic adder 8 serves for determination of a required positioning angle of the working implement 10 and comprises a rotary cine-cosine transformer 24 (FIG. 3) inserted in such a manner as to determine the hypothenuse and angle with preset catheti of a triangle. One of the rotor windings 25 of the adder 8 is connected, via an amplifier 26, to a motor 27. The shaft of the motor 27 is connected to the rotor of the transformer 24 and to a sliding contact of a circular potentiometer 28 which is used as converter for conversion of angle into an electric signal.

Sine and cosine voltages are supplied to stator windings 29 and 30, respectively, of the transformer 24. In accordance with the value of this voltage across the windings 29 and 30, the motor 27 brings the rotor of the transformer 24 into a position such that the voltage at the output of the rotor winding 25 should become nil. Concurrently with the rotation of the rotor of the transformer 24, the sliding contact of the circular potentiometer 28 is also rotated so that an output signal is obtained at this contact which is proportional to the angle of rotation of the rotor and which is the output signal of the algebraic adder 8.

Figure 4:
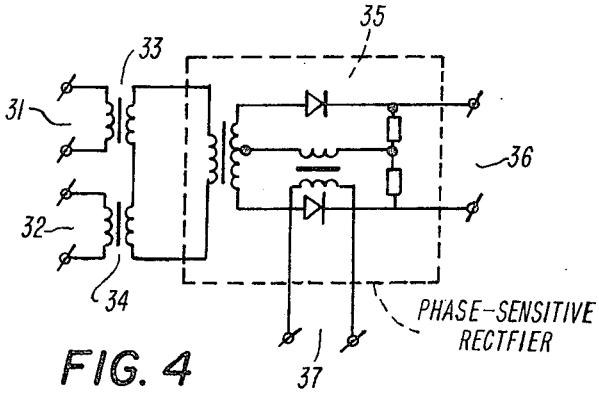
FIG. 4 is an electric diagram of the algebraic adder of FIG. 3.

The algebraic adder 8 may comprise two transformers 33, 34 (shown in FIG. 4) having primary windings 31, 32 connected to the comparison circuits 3 and 4, the secondary windings of these transformers being connected in series and coupled to a phase-sensitive rectifier 35 with a reference voltage at 37 represented by sine voltage of the same frequency and phase as the voltage supplied to the primary winding 31, 32 of one of these transformers 33, 34.

The comparison circuit 11 may comprise a bridge circuit having adjacent arms in which there are oppositely inserted the signals from the sensor 9 and algebraic adder 8 which are to be compared.

The controllers 1 and 2 comprise circular potentiometers having the scales in degrees.

The apparatus operates as follows.

During the drilling of a borehole the voltage from the controllers 1 and 2, which is proportional to preset values of the angles of inclination and azimuth at a predetermined depth of the borehole, is compared in the comparison circuits 3 and 4 with the voltage at the output of the sensors 5 and 7, which are proportional to measured values of the angles of inclination and azimuth of the borehole. The result of comparison in the circuit 3 is converted into sine voltage and in the circuit 4 into cosine voltage. The algebraic adder 8 effects the addition of these two voltages, whereby a voltage corresponding to a required angle of rotation of the working implement 10 appears at the output of the adder.

The comparison circuit 11 compares the voltage from the output of the adder 8 with the voltage at the output of the sensor 9 corresponding to the position of the working implement 10 in the borehole as measured by the deep compass 6. The signal from the output of the circuit 11 is fed to the actuator 12, into the electric drive 13, which shifts, by means of the rotor 14 and the drilling string 15, the working implement 10 into a position such that the output signal of the circuit 11 becomes nil.

This implies that the value characterizing the position of the working implement 10 as measured by the deep compass 6 corresponds to the value of voltage at the output of the adder 8, that is to such required angle of rotation of the working implement 10 which ensures the drilling of the borehole along a predetermined path.

During the entire period of drilling of the borehole the apparatus will automatically maintain such required position of the working implement 10 as to ensure preset values of the angles of inclination and azimuth of the borehole along the whole length thereof.

What is claimed is:

1. An apparatus for positioning a working implement in a borehole comprising: an actuator for changing the position of a working implement; an electronic deep compass having deep-hole sensors, one sensor sensing the angle of inclination of the borehole axis with respect to the vertical, one sensor sensing the azimuth of the borehole, and one sensor sensing the angle of the position of the working implement with reference to the vertical plane tangential to the borehole axis at the measurement point; a surface means for controlling the position of said working implement connected to said sensors and generating a signal in accordance with deviations of output signals of said sensors from preset values, said means comprising an azimuth controller, an angle of inclination controller and three comparison circuits of which two circuits are connected in such a manner that a first comparison circuit is connected to said azimuth sensor and a controller for the borehole azimuth, and a second comparison circuit is connected to said inclination sensor and a controller for the borehole inclination, one of said first and second comparison circuits generating a sine signal and the other a cosine signal, the amplitude of each signal being proportional to the difference between the signals of the sensor and controller, respectively, and an algebraic adder which is connected to said first and second comparison circuits, said algebraic adder together with said sensor sensing the angle of positioning of the working implement being connected to a third of said comparison circuits which has the output thereof connected to said actuator for controlling the operation thereof, whereby the positioning of the working implement is effected until the signal at the output of said third comparison circuit becomes nil.

2. An apparatus according to claim 1, wherein the algebraic adder comprises a rotary sine-cosine transformer inserted in such a manner as to determine the hypothenuse and angle with preset catheti of a triangle, and an angle/electric signal converter comprising a variable resistor having a sliding contact connected to the rotor of the rotary transformer.

3. An apparatus according to claim 1, wherein the algebraic adder comprises a phase-sensitive rectifier and two transformers, the primary winding of each transformer being connected to one of the comparison circuits for the angles of inclination and azimuth of the borehole, and the secondary windings of the transformers being connected in series and coupled to the phase-sensitive rectifier whose reference voltage is in phase with the voltage supplied to the primary winding of one of the transformers.

4. An apparatus according to claim 1, wherein the comparison circuits for preset and measured angles of inclination and azimuth of the borehole comprises a magnetic amplifier having an output frequency which is twice as high as the frequency of the voltage supplied to the working windings thereof, one of the working windings being supplied with sine voltage and the other cosine voltage.

* * * * *